United States Patent [19]

Zunkel

[11] Patent Number: 4,696,500

[45] Date of Patent: Sep. 29, 1987

[54] DOORHOLDER ASSEMBLY FOR A POCKET DOOR

[76] Inventor: Richard L. Zunkel, 218 Loon Ct., Foster City, Calif. 94404

[21] Appl. No.: 815,549

[22] Filed: Jan. 2, 1986

[51] Int. Cl.[4] ..... E05C 17/56

[52] U.S. Cl. ..... 292/251.5; 292/DIG. 60

[58] Field of Search ..... 292/251.5, 144, 201, 292/251, DIG. 60; 411/544

[56] References Cited

U.S. PATENT DOCUMENTS

| | | | |
|---|---|---|---|
| 49,560 | 8/1865 | Shaw | 411/544 |
| 2,472,397 | 6/1949 | Bennett | 292/251.5 |
| 2,673,377 | 3/1954 | Gaugler | 292/251.5 X |
| 2,801,870 | 8/1957 | Davey | 292/251.5 |
| 3,751,088 | 8/1973 | Schlage et al. | 292/201 |
| 4,458,940 | 7/1984 | Hildebrand | 292/DIG. 60 X |

*Primary Examiner*—Richard E. Moore

[57] ABSTRACT

The present invention relates to a doorholder assembly for a pocket door including a housing mountable on a vertical surface of the wall inside the pocket, an electromagnet having an armature engaging surface, an armature mounted on the door, adjustable mounting means for mounting the electromagnet to the housing to vary the distance that the armature engaging surface is disposed relative to the surface of the wall on which the housing is mounted to accommodate various door and pocket sizes to enable the visible surface of the door when in its held open position to be aligned coplaner with the wall outside of the pocket. Resilient means are associated with the armature to allow the armature to pivot relative to the armature engaging surface to compensate for angular misalignment between the armature and the armature engaging surface. The resilient means further absorbs vibration established upon energization of the electromagnet by AC current and prevents the transmittal of the vibration from the electromagnet to the door.

3 Claims, 4 Drawing Figures

DOORHOLDER ASSEMBLY FOR A POCKET DOOR

BACKGROUND OF THE DISCLOSURE

1. Field of the Invention

The present invention relates to a universal electromagnetic doorholder and more particularly to an electromagnetic doorholder for a pocket door which is adjustable for use with variance size doors and pockets to enable the visible surface of the door when in its open position to be aligned coplaner with the wall outside of the pocket.

Doorholder assemblies and electromagnetic doorholder assemblies are well known in the art. These known assemblies include fixed electromagnets that maintain a predetermined distance between the door and the wall on which the electromagnet is located. Problems are encountered when the known assemblies are utilized with pocket doors. Generally, pocket doors must be located in a predetermined position when held open so that the visible surface of the door when in its held open position is aligned coplaner with the wall outside of the pocket. This is accomplished with difficulty in the prior art by use of shims when mounting the electromagnet to thereby accommodate various size doors and pockets. The prior art also suffers from the disadvantage that vibration established in the AC coil of the electromagnet is transferred from the electromagnet to the armature which is mounted on the door and then to the door thereby resulting in annoying vibrations in the door when the door is held in its open position by the doorholder assembly.

It is desireable to provide a universal doorholder assembly which is easily adaptable at the job site to doors and pocket constructions of various sizes and which can be adjusted in the field to align the visible surface of the door when in its held open position with the wall in which the pocket is located. Additionally, it is desireable to provide a doorholder assembly which is adaptable to compensate for misalignment between the electromagnetic door holder and the armature which is generally attached to the door.

The present invention describes a new and improved doorholder assembly which is adjustable in the field to enable the visible surface of the door when in its held open position to be precisely aligned coplaner with the wall in which the pocket is disposed, which is adapted to compensate for angular misalignment between the electromagnet and the armature located on the door and which is further adapted to isolate the door from vibration generated upon AC energization of the coil of the electromagnet.

2. Prior Art

The known prior art provides electromagnets which are well known for holding open doors. However, the known electromagnets are not adjustable in the field without shims to allow alignment of the door with the wall in which the pocket is located. Additionally, the rigid construction of the known prior art electromagnetic door holder allows annoying vibrations established upon energization of the electromagnet by an AC current to be passed from the electromagnet to the door.

SUMMARY OF THE INVENTION

The present invention relates to a new and improved doorholder assembly for a pocket door which includes an adjustable mounting means which is adjustable to vary the distance that the electromagnet is disposed relative to the surface of the wall on which the housing is mounted to enable the visible surface of the door when in its open position to be aligned coplaner with the wall outside of the pocket.

The present invention further relates to a new and improved doorholder assembly which includes an electromagnet and an armature mounted on the door wherein a resilient means is provided to allow the armature member to move relative to the door to compensate for angular misalignment between the armature and the electromagnet.

The present invention relates to a new and improved doorholder assembly as set forth in the preceeding paragraph wherein the resilient means absorbs vibration established upon energization of the electromagnet by AC current and prevents the transmittal of the vibration from the electromagnet to the door.

Another provision of the present invention is to provide a doorholder assembly for use with a pocket door which is biased by a doorcloser from its open position to its closed position including a housing mountable on a vertical surface of a wall inside the pocket, an electromagnet supported by the housing, the electromagnet having an armature engaging surface, an armature mountable on the door and being movable with the door, adjustable mounting means for mounting the electromagnet to the housing being adjustable to vary the distance that the armature engaging surface of the electromagnet is disposed relative to the surface of the wall on which the housing is mounted to enable the visible surface of the door when in its open position to be aligned coplaner with the wall outside of the pocket and means for selectively energizing and de-energizing the electromagnet.

A still further provision of the present invention is to provide a doorholder assembly for use with a pocket door which is biased by a doorcloser from its open position to its closed position including a housing mountable on a vertical surface of a wall inside of the pocket, an electromagnet supported by the housing and having a armature engaging surface thereon, an armature mounted on the door and being movable therewith into engagement with the armature engaging surface of the electromagnet when the door is in its open position and wherein, the armature includes a metallic member which is attracted to the armature engaging surface when the electromagnet is energized, a mounting member for mounting the metallic member on the door and resilient means disposed between the metallic member and the mounting member. The resilient means allows the metallic member to move relative to the mounting member to compensate for angular misalignment between the metallic member and the armature engaging surface of the electromagnet and also absorbs vibration established upon energization of the electromagnet by AC current to prevent the transmittal of the vibration from the electromagnet to the door.

DESCRIPTION OF THE PREFERRED EMBODIMENT

Figure 1:
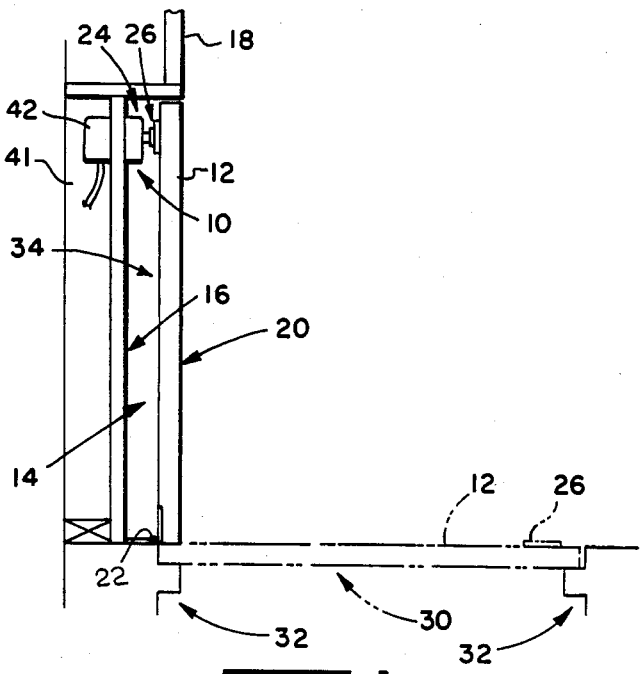
FIG. 1 is a top-schematic view of a door and the doorholder of the present invention when the door is in its held open position.

A doorholder assembly 10 which is particularly adapted for holding a pocket door 12 in its open position is disclosed in FIG. 1. The door 12 is normally biased by a conventional doorcloser, not illustrated, from the doors open position shown in full lines in FIG. 1 to the doors closed position shown in phantom lines in FIG. 1. The door 12 when opened is adapted to be recessed in a pocket 14 having a vertical wall 16 in a wall 18 of a structure such as a building. The door 12 is adapted to pivot about a hinge 22 from its full line position to the position shown in phantom lines in FIG. 1 in which the door 12 closes opening 30 in a wall 32. When the door is held in its open position by the doorholder assembly 10, it is desirable to have the visible surface 20 of the door 12 extend substantially coplaner with the surface of the wall 18 to allow the door 12 to be esthetically appealing relative to the wall 18 when in its held open position.

The doorholder assembly 10 includes a portion 24 which is affixed to the vertical wall 6 disposed in the pocket 14 and a portion 26 which is mountable on the surface 34 of the door 12. The portion 26 is movable with the door 12 as it moves from its open position to its closed position.

Figure 2:
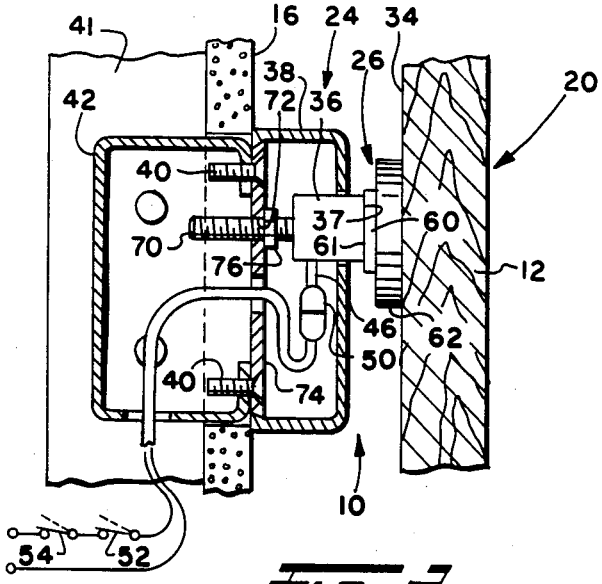
FIG. 2 is a cross-sectional view of the doorholder assembly of the present invention.

Referring to FIG. 2 the portion 24 of the doorholder assembly 10 which is mountable on the wall 16 is more fully illustrated. The portion 24 includes an electromagnet 36 which is in part supported by a housing 38. The housing 38 is adapted to be supported on the wall 16 by fastener means which in the preferred embodiment are bolts 40. Typically, an outlet box 42 is supported on a stud 41 in a well known manner. The outlet box 42 is disposed interiorly of the wall 16 to bring power to the doorholder 10 and the screws 40 secure the housing 38 to the oulet box 42 supported by stud 41 in a conventional manner. A power supply is provided to the outlet box 42 in the form of wires 44 to supply current to the electromagnet 36. The electromagnet 36 includes a pair of leads 46 extending therefrom which are connectable via a plug type connector 50 to the power wires 44. The power is supplied through the wires 44 in a well known manner.

A sensor 52 is preferably provided to control the power on the power lines 44 for selectively energizing and de-energizing the electromagnet 36 based upon a condition to which the sensor is responsive. For example, the sensor 52 may be a fire sensor and normally is in its closed full line position as is illustrated in FIG. 2 to energize electromagnet 36. Upon the occurrence of a fire which is sensed by the sensor 52, the switch in the sensor moves to its open, phantom line position, to de-energize electromagnet 36 allowing the door 12 to close under the influence of the doorcloser, not illustrated, in a well known manner. A second sensor or switch 54 can be provided in series with the first sensor 52. The second switch may for example be a panic switch which when activated opens to de-energize electromagnet 36 thereby allowing the door 12 to close as will the more fully disclosed herein below.

The portion 26 of the doorholder assembly 10 which is mounted on the door 12 is an armature portion. The portion 26 includes a metallic or attractable armature member 60 which is mounted on the door 12 by a mounting ring 62. The mounting ring 62 is secured to the door 12 by a pair of screw members 64. The mounting ring 62 includes a central opening therein in which the metallic armature member 60 is disposed. When the door 12 is in its open position the electromagnet 36 will be located adjacent to the metallic member 60 and when the electromagnet 36 is energized, the metallic member 60 will be attracted to an armature engaging surface 37 on the electromagnet 36 to thereby hold the door 12 in its open position. A doorcloser, not illustrated, whose construction is well known in the art is normally attached to the door 12 to bias the door 12 toward its closed phantom line position as is illustrated in FIG. 1. However, the doorholder assembly 10 is operable, when energized, to overcome the closing force of the doorcloser to hold the door 12 in its open position.

The electromagnet 36 is mounted within the housing 38 on one end of a threaded member 70. The threaded member 70 is adapted to be threaded into an opening 72 located in a backplate 74 of the housing 38. Rotating the threaded member 70 and the electromagnet 36 allows the distance that the armature engaging surface 37 is disposed relative to the wall 16 to be adjusted. A locknut 76 is disposed about the threaded member 70 and is adapted to fix the threaded member 70 and the electromagnet 36 relative to the backplate 74 of housing 38. The locknut 76 is utilized to secure the electromagnet 36 in a predetermined position after the threaded member 70 has been adjusted to adjust the distance that the armature engaging surface 37 is disposed relative to the wall 16. This allows the electromagnet 36 to be projected more or less from the housing 38 as is required to accommodate various door and pocket sizes to align the visible surface 20 of the door 12 with the wall 18. Normally, adjustment is accomplished by loosening the locknut 76, unplugging the connector 50 and rotating the threaded post 74 in a clockwise or a counter clockwise direction depending upon whether it is desired to project the electromagnet 36 more or less from the housing. After the electromagnet is positioned to align the visible surface 20 of the door 12 when in its open position with the wall 18, the locknut is tightened and the power is reconnected to the electromagnet through the connector 50.

The armature assembly 26 is adapted to compensate for minor angular misalignment between the armature engaging surface 37 of the ielectromagnet and the metallic member 60 which is adapted to engage with the armature engaging surface 37 of the electromagnet 36. As is more fully shown in FIGS. 3 and 4, the metallic member 60 includes an electromagnet engaging surface 61 and a annular shoulder 80. The mounting ring 62 includes a corresponding annular shoulder 82. The annular shoulder 82 is adapted to interfere with the shoulder 80 on the metallic member 60 to secure the member 60 within the mounting ring 62 on the door 12. A resilient means in the form of a resilient O-ring 84 is disposed between the shoulder 82 on the mounting ring 62 and the shoulder 80 on the metallic member 60. The resilient O-ring 84 allows the metallic member 60 to pivot slightly relative to the mounting ring 62 to compensate for minor angular misalignment between the surface 61 of the metallic member 60 and the surface 37 of the electromagnet 36. The resilient ring 84 allows the metallic member 60 to pivot slightly so that the surface 61 fully engages the surface 37 of the electromagnet 36, thereby maximizing the holding power of the electromagnet 36. A slight space 86 is provided between the metallic member 60 and the surface 34 of the door 12 to allow the metallic member 60 to pivot slightly within the mounting ring 62 relative to the door 12.

Figure 3:
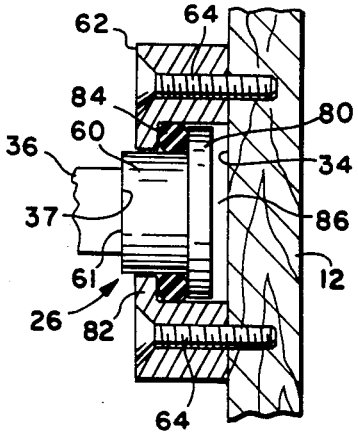
FIG. 3 is a fragmentary sectional view of the armature disk and the mounting means therefore when the armature disk is attracted to the electromagnet.
Figure 4:
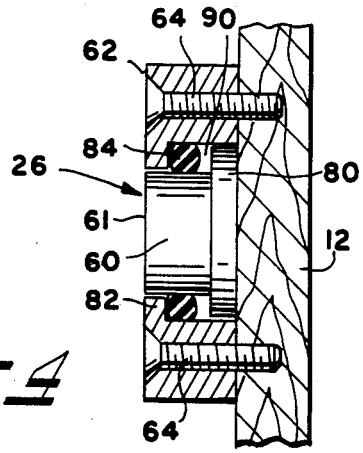
FIG. 4 is a fragmentary cross-sectional view similar to FIG. 3 but illustrating the armature disk in a condition in which it is not attracted to the electromagnet.

FIG. 3 illustrates the position of the metallic member 60 when the surface 61 is engaged with a surface 37 of the electromagnet 36 and the door 12 is in its held open position. When the door is held open by the doorholder 10 the doorholder 10 is overcoming the biasing force of the doorcloser which still biases the door closed. Thus, the space 86 between the door 12 which is biased closed by the doorcloser and the metallic member 60 which is attracted to the electromagnet 36 and which overcomes the force of the doorcloser. In this position, the shoulder 80 of the metallic member 60 engages and compresses the resilient ring 84 to compensate for misalignment and the ring 84 isolates the door 12 from any vibration established by the electromagnet 36. In the position illustrated in FIG. 4, the armature member 60 is not attracted to the electromagnet 36 and is loosely secured in the mounting member 62. The looseness establishes the space 90 between the resilient ring 84 and a shoulder 80. However when the metallic member 60 is attracted to the electromagnet 36, the space 90 essentially disappears as the shoulder 80 engages with the resilient ring 84 as is more fully illustrated in FIG. 3.

When the electromagnet 36 is energized by AC current, the AC current establishes a slight vibration or hum in the electromagnet 36 which would be undesirable if transmitted to the door 12. The resilient O-ring 84 acts to isolate the mounting ring 62 and door 12 from the member 60 and the electromagnet 36 which is engaged therewith to thereby prevent vibration from being transferred from the electromagnet 36 to the door 12.

From the forgoing it should be apparent that a new and improved universal doorholder assembly 10 has been provided which is particularly adapted for use with various size pocket doors and pockets. The doorholder assembly 10 includes an electromagnet 36 supported by a housing 38 which is mountable on a vertical surface of the wall 16 within the pocket 14. The electromagnet 36 includes an armature engaging surface 37 and an armature 26 is mounted on the door 12 for movement therewith. The electromagnet 36 is disposed on an adjustable mounting means in the form of a threaded member 70 to allow the distance that the armature engaging surface is disposed relative to the surface of the wall 16 to be adjusted to accommodate various door and pocket sizes so that the visible surface 20 of the door 12 when in its held open position is aligned coplaner with the wall 18 outside of the pocket. Sensor means are provided for selectively energizing and de-energizing the electromagnet 36 and a resilient member 84 is disposed between the armature member 60 and the mounting ring 62 to compensate for minor angular misalignment between the armature engaging surface 37 of the electromagnet 36 and the surface 61 of the metallic member 60 and to absorb vibration caused by alternating current energization of the electromagnet 36.

What is claimed is:

1. A doorholder assembly for use with a pocket door which is biased by a doorcloser from an open position in which the door is located in a pocket in a wall toward a closed position, said doorholder assembly comprising a housing mountable on a vertical surface of the wall inside the pocket, an electromagnet supported by said housing, said electromagnet having an armature engaging surface, an armature mountable on the door to be movable with the door when the door moves from its closed position to its open position into engagement with said armature engaging surface of said electromagnet, adjustable mounting means for mounting said electromagnet to said housing and being adjustable to vary the distance that said armature engaging surface is disposed relative to the surface of the wall on which said housing is to be mounted to enable the visible surface of the door when in its held open position to be aligned coplaner with the wall outside of the pocket and means for selectively energizing said electromagnet to attract said armature to said armature engaging surface to override the biasing force of the doorcloser to hole the door in its open position and de-energizing said electromagnet to release said armature from said armature engaging surface allowing the door to be biased toward its closed position, said armature including an annular metallic member having an annular shoulder thereon, said metallic member being attractable to said armature engaging surface when said electromagnet is energized, an annular mounting member for mounting said metallic member on the door, said annular mounting member having an annular opening disposed therein through which said annular metallic member projects to engage with said armature engaging surface of said electromagnet and an annular shoulder disposed about said annular opening, said annular shoulder on said mounting member having a diameter which is less than the diameter of the annular shoulder on said metallic member to provide an interference fit between said metallic member within said annular opening in said mounting member and limit movement of said metallic member relative to said mounting member, and compressable resilient means disposed between said annular shoulder on said metallic member and said annular shoulder on said mounting member, said annular metallic member being movable toward said annular mounting member when said metallic member is attracted to said armature engaging surface to compress said resilient means between said annular shoulder located on said metallic member and said annular shoulder located on said mounting member, said resilient means when compressed allowing said metallic member to move relative to said mounting member to compensate for angular misalignment between said metallic member and said armature engaging surface, and wherein said resilient means comprises a resilient ring, said electromagnet when energized establishing vibration therein from the AC current passing therethrough which is transmitted to said metallic member when said metalic member is engaged with said armature engaging surface of said electromagnet, said resilient ring absorbing vibration established upon energization of the electromagnet by AC current and preventing the transmittal of said vibration from the electromagnet and the metallic member, to the mounting ring and the door.

2. A doorholder assembly for the use with a door which is biased by a doorcloser from an open position toward a closed position, said doorholder assembly comprising a housing mountable on a vertical surface of the wall, an electromagnet supported by said housing, said electromagnet having an armature engaging surface, an armature mountable on the door to be movable with the door moves from its closed position to its open position into engagement with said armature engaging surface of said electromagnet, said armature including an annular attractable member having an annular shoulder thereon, said attractable member being attractable to said armature engaging surface when said electromagnet is energized, an annular mounting member for mounting said attractable member on the door, said annular mounting member having an annular opening disposed therein through which said annular attractable member projects to engage with said armature engaging surface of said electromagnet and an annular shoulder disposed about said annular opening, said annular shoulder on said mounting member having a diameter which is less than the diameter of the annular shoulder on said attractable member to provide an interference fit between said annular shoulder on said attractable member and said annular shoulder on said annular mounting member which secures said attractable member within said mounting member and limits movement of said attractable member relative to said mounting member, and compressable resilient means disposed between said annular shoulder on said annular attractable member and said annular shoulder on said annular mounting member, said resilient means being compressed by relative movement of said annular shoulder on said attractable member and said annular shoulder on said annular mounting member to allow said attractable member to move relative to said mounting member to compensate for angular misalignment between said attractable member and said armature engaging surface of said electromagnet and means for selectively energizing said electromagnet to attract said armature to said armature engaging surface to override the biasing force of the doorcloser to hold the door in its open position and de-energizing said electromagnet to release said armature from said armature engaging surface allowing the door to be biased toward it closed position by said doorcloser, wherein said resilient means comprises a resilient ring disposed between said annular shoulder on said attractable member and said annular shoulder on said mounting member, said annular shoulders of said attractable member and mounting member moving toward each other and compressing said resilient ring when said attractable member is attracted to said armature engaging surface, said electromagnet when energized establishing vibration therein from the AC current passing therethrough which is transmitted to said attractable member when said attractable member is engaged with said armature engaging surface of said electromagnet, said resilient ring when compressed absorbing vibration established upon energization of the electromagnet by AC current to prevent the tramsmittal of said vibration from the attractable member to the door.

3. A doorholder assembly as defined in claim 2 wherein said means for selectively energizing said electromagnet comprises a sensor for selectively energizing said electromagnet to control the energization and de-energization of said electromagnet in dependence upon a condition to which said sensor is responsive.

* * * * *